US005174029A

United States Patent [19]

Talberg

[11] Patent Number: 5,174,029

[45] Date of Patent: Dec. 29, 1992

[54] CHAIN SAW TENSIONING MECHANISM

[75] Inventor: James R. Talberg, Centerville, Minn.

[73] Assignee: JT Investments, Ham Lake, Minn.

[21] Appl. No.: 805,028

[22] Filed: Dec. 11, 1991

[51] Int. Cl.[5] ..... B27B 17/14

[52] U.S. Cl. ..... 30/386; 30/385; 30/387

[58] Field of Search ..... 30/385, 386, 387, 123.4; 83/816

[56] References Cited

U.S. PATENT DOCUMENTS

| | | | |
|---|---|---|---|
| 2,532,981 | 12/1950 | Wolfe | 30/385 |
| 3,194,284 | 7/1965 | Walker | 30/386 |
| 3,279,508 | 10/1966 | Ehlen et al. | 30/385 |
| 3,636,995 | 1/1972 | Newman | 30/386 |
| 3,866,320 | 2/1975 | Progl | 30/386 |
| 4,129,943 | 12/1978 | Bricker | 30/386 |
| 4,361,960 | 12/1982 | Halverson | 30/385 |
| 4,382,334 | 5/1983 | Reynolds | 30/386 |
| 4,567,658 | 2/1986 | Wissmann et al. | 30/386 |
| 4,920,650 | 5/1990 | Edlund | 30/386 |

*Primary Examiner*—Douglas D. Watts
*Assistant Examiner*—Hwei-Siu Payer
*Attorney, Agent, or Firm*—Lawrence M. Nawrocki

[57] ABSTRACT

A mechanism for tensioning the chain of a chain saw. The apparatus includes a cutting bar around which the chain extends. The cutting bar has a base portion mounted to an operating housing of the chain saw, and a distal portion carried by the base portion at an end thereof remote from the housing. The distal portion of the cutting bar is disposed for sliding extension relative to the base portion of the cutting bar. The distal portion of the cutting bar mounts a sprocket, around which the chain passes, at an outer end thereof. The sprocket is disposed for rotation about an axis. Structure is included to effect extension of the distal portion of the cutting bar relative to the base portion thereof. Tensioning of the chain saw is, thereby, accomplished.

10 Claims, 2 Drawing Sheets

CHAIN SAW TENSIONING MECHANISM

TECHNICAL FIELD

The present invention deals broadly with the field of cutting implements. More narrowly, however, the present invention is related to cutting implements known as chain saws. The focus of the invention is structure employed to maintain a proper tension on the cutting chain of a chain saw.

BACKGROUND OF THE INVENTION

Various types of cutting implements are known in the prior art. The particular implement that would be selected by a person would, of course, depend upon the function to be achieved.

One particular application for a cutting instrument is one wherein heavy wooden items are to be sawed. An example of this type of use is the logging industry wherein trees are cut down, cut into segments, etc. An implement known as a chain saw is used to effect this function.

On a smaller scale, homeowners purchase and use chain saws, for example, to prune trees in their yards. That is not to say that chain saws, in a residential environment, do not have other applications. The chain saw is, in fact, a very versatile appliance.

Use of chain saws dictates certain features be incorporated into the device. The features are functions of a desire to maximize efficiency and minimize dangers in use. A feature which derives from both of these considerations is one wherein the chain is maintained in a taut configuration both at start-up and during use. Certainly, the more taut the chain is, the more efficiently the appliance will cut. If the chain is slack, the cutting process will be slower, and the cut-line will be less clean.

Probably of more significance is the safety aspect. It is essential that all precautions be taken when utilizing any implement having a cutting element which is moving at a very high rate of speed. This dictate is particularly necessary to be observed in the case of chain saws.

In furtherance of maximization of safety, it is extremely important that unnecessary slack be eliminated from the run of the chain saw chain. If too much slack is present, it might even be possible for the chain to jump off the sprockets over which it runs. As will be clear to the casual observer, if this occurred, the results could be disastrous.

If the chain is not maintained in a taut configuration, the chain could, possible, snap. A tension might become applied while the equipment were running and slack might be eliminated in a microsecond. This application of a high measure of tension in a very short period of time can result in the breaking of the chain. Again, one can envision the hazard to life and limb that would result.

It is optimum, therefore, that the chain of a chain saw be maintained uniformly at an appropriate level of tension. By doing so, both efficiency and safety are maximized.

It is to these problems and dictates of the prior art that the present invention is directed. It is an improved tensioning mechanism for use in a chain saw application.

SUMMARY OF THE INVENTION

The present invention is a structure which functions to tension the chain of the chain saw in order to achieve an appropriate level of uniform tensioning of the chain. It includes a cutting bar around which the chain is made to extend. The cutting bar is bifurcated to include a base portion and a distal portion. The base portion is mounted to an operating housing of the chain saw, and the distal portion is carried by the base portion at an end thereof remote from the operating housing. The distal portion is disposed for sliding extension relative to the base portion. The distal portion carries a sprocket at its outer end. The run of the chain passes over the sprocket, and the sprocket is disposed for rotation about an axis in order to facilitate operation of the implement. Means are included for extending the distal portion of the cutting bar relative to the base portion thereof in order to apply the desired measure of tension to the chain.

A first embodiment of the invention, while it is intended to be hydraulic in operation, can also function pneumatically. In this embodiment, the base portion of the cutting bar is provided with a channel therewithin. The channel, it is intended, would run generally parallel to inner and outer runs of the continuous chain. An access port is provided to communicate with the channel, and this port is formed through a wall defined by the base portion of the cutting bar. Typically, the access port would be proximate an inner end of the channel.

The distal portion of the cutting bar, in this embodiment, is provided with an inwardly extending piston. The piston is received within the channel for telescoping movement relative thereto. An inner edge of the piston closes the channel to define a plenum inwardly from the piston. Fluid can be injected into this plenum through the access port. As fluid, such as grease, is injected into the plenum, the fluid acts upon the piston to urge it outwardly. As a result, extension of the distal portion of the cutting bar, relative to the base portion, is effectuated.

In order to maintain the tension applied, the access port is normally closed and affords one-way passage of fluid into the plenum. This can be accomplished by the means of a ball valve, a ball of which is biased outwardly within the plenum to be normally seated against the port. With a structure so configured, grease can be inserted into the port, and the insertion of the grease will overcome the bias of the check valve. After the injection device is withdrawn, however, the valve will close to preclude leakage of the fluid outwardly through the access port.

Similarly, means can be provided for precluding leakage of the fluid outwardly through the channel. This can be accomplished by means of sealing the piston relative to the inner wall defining the channel. A block seal can be utilized for this purpose. Other appropriate sealing means could also be employed.

A second embodiment of the invention is mechanical in operation. That is, it employs mechanical actuation means urging the piston outwardly, rather than hydraulic or pneumatic means.

One mechanical actuation means embodiment employs a cam received within a generally circular aperture within the base portion of the cutting bar. An outermost edge of the cam, typically, would be in close proximity to a circumferential edge of the generally circular aperture within the base portion of the cutting bar, and an outer surface of the cam would be in engagement with an inner edge of the piston which extends into the generally circular aperture. The cam is disposed for rotation about an axis generally transverse to an intended direction of extension of the distal portion of the cutting bar. As a result, as the cam is rotated about the axis in a first direction, the piston will be urged outwardly.

In this embodiment, the outermost edge of the cam can be provided with an outwardly biased pawl. The pawl can be provided with teeth, and the circumferential edge of the generally circular aperture within the base portion of the cutting bar can be toothed in a manner so that it cooperates with the teeth of the pawl. As a result, as the cam is made to rotate in a first direction, the pawl/toothed circumferential edge assembly will preclude rotation of the cam in a second direction which would permit retraction of the distal portion of the cutting bar relative to the base portion.

A third embodiment of the invention is intended to be substantially automatic in operation. That is, it is intended that, in this embodiment, the tension be automatically adjusted.

In this embodiment also, a reciprocally disposed piston is provided. The inner end of the piston is tapered on both sides to define ramped surfaces. The piston is normally biased outwardly by means of a strong spring which engages the base of a channel within the base portion of the cutting bar, at one end, and an inner edge of the piston, at the other.

It will be understood that, possibly, such outward biasing of the piston might be overcome during operation of the chain saw. As a result, in this embodiment, a pair of ramped members can be provided within the channel within which the piston reciprocates. The ramp members are in positions engageable with the ramped surfaces of the piston. The ramp members are also outwardly biased so that, when the chain of the saw is not subject to external forces and the strong spring biasing of the piston in an outward direction occurs, the ramp members will be biased into positions to wedge the piston against subsequent withdrawal.

If desired, the ramp members are provided with pins which ride along tracks in the cutting bar. Such cooperation enables appropriate positioning of the ramp members.

The present invention is thus an improved apparatus for tensioning the chain of a chain saw implement. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
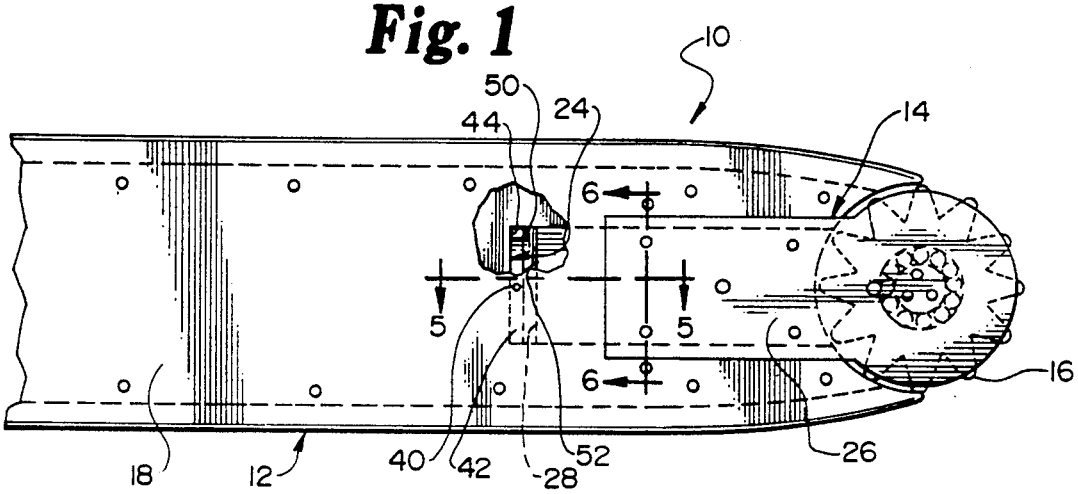
FIG. 1 is a fragmentary side elevational view of a first embodiment of a chain saw tensioning device in accordance with the present invention.

Referring now to the drawings wherein like reference numerals denote like elements throughout the several views. FIG. 1 illustrates a first embodiment of a structure in accordance with the present invention. That figure shows the end of a chain saw cutting bar 10 which is remote from the operating housing (not shown) of a chain saw implement. A chain (not shown) having cutting teeth mounted thereto, extends around the cutting bar 10 and runs at a high speed to effect cutting.

FIG. 1 (and FIGS. 2 and 3 also) illustrate a cutting bar 10 which is bifurcated. That is, the cutting bar is comprised of two portions. A base portion 12 of the bar 10 is mounted to the operating housing, and a distal portion 14 of the bar 10 is carried by the base portion 12 at an end thereof which is remote from the housing.

The distal portion 14 of the cutting bar 10 is disposed for reciprocating movement relative to the base portion 12. As will be seen hereinafter, as the distal portion 14 is made to move outwardly relative to the base portion 12, the chain extending over the cutting bar 10 will be tensioned in view of the fact that an outer end of the distal portion 14 mounts a sprocket 16 over which the chain passes.

Figure 2:
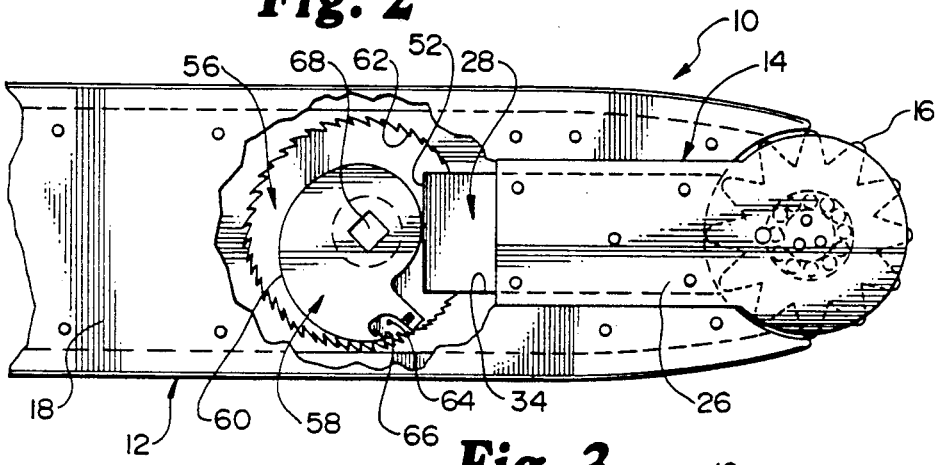
FIG. 2 is a view similar to FIG. 1 showing a second embodiment of the invention.
Figure 3:
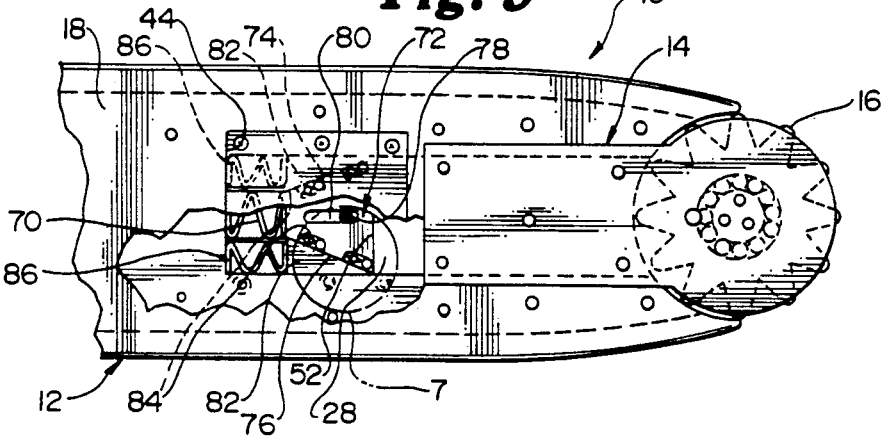
FIG. 3 is a view similar to FIG. 1 showing a third embodiment of the invention.

All three embodiments illustrated in FIG. 1-3 function to accomplish tensioning of the chain by urging the distal portion 14 of the cutting bar 10 outwardly from the base portion 12. The embodiment illustrated in FIG. 1, however, functions hydraulically or pneumatically. FIG. **4*b* illustrates the end of the base portion 12 of the cutting bar 10 remote from the operating housing. As seen in that figure, the base portion 12 can be laminar in configuration. Lateral closure plates 18 sandwich therebetween upper and lower track members 20, 22. A window 24 is defined within the end of the base portion 12 remote from the operating housing, and the size and shape of the window 24 is such that the distal portion 14 of the cutting bar 10 can be received within the window 24** for longitudinal movement therealong.

Figure 4A:
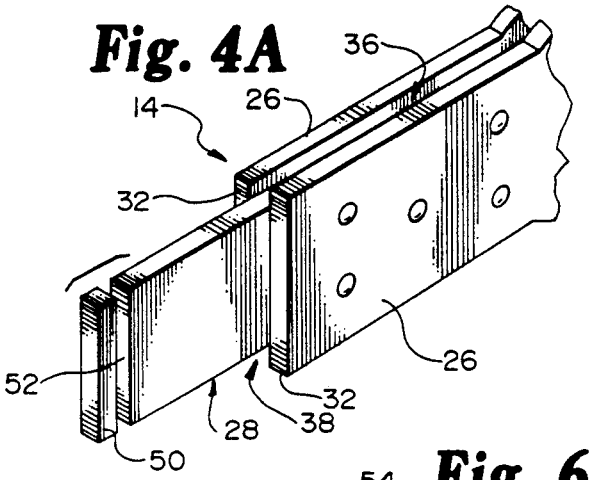
FIG. 4A is an enlarged perspective view of a piston carried by a distal portion of a cutting bar.

As in seen in FIG. 4A, the distal portion 14 of the cutting bar 10 is also laminar in construction. A pair of lateral plates 26 sandwich a piston 28 therebetween. The piston 28 is provided with a vertical dimension substantially the same as the distance 30 between upper and lower tracks defined by corresponding upper and lower track members 20, 22 sandwiched between the lateral plates 18 of the base portion 12 of the cutting bar 10. The piston 28 extends inwardly from inner edges 32 of the plates 26 sandwiching the piston 28 therebetween.

Figure 4B:
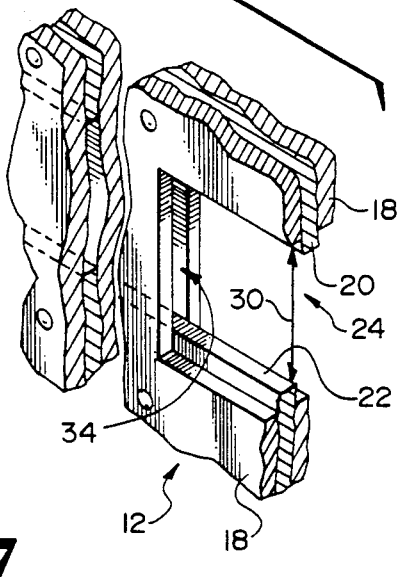
FIG. 4B is a fragmentary perspective view of a base portion of a cutting bar.

Referring again to FIG. 4B, it can be seen that the upper and lower track defining members 20, 22 are such that they are spaced vertically from one another. As will be able to be seen then, a longitudinally-extending channel 34 is formed within the base portion 12 of the cutting bar 10. The distal portion 14 and base portion 12 of the cutting bar 10 cooperate so that the piston 28 extending inwardly with respect to the inner edges 32 of the plates 26 of the distal portion 14 of the cutting bar 10 extends into the channel 34 as upper and lower grooves 36, 38 formed in the distal portion 14 ride along the upper and lower track members 20, 22 provided in the base portion 12.

Figure 5:
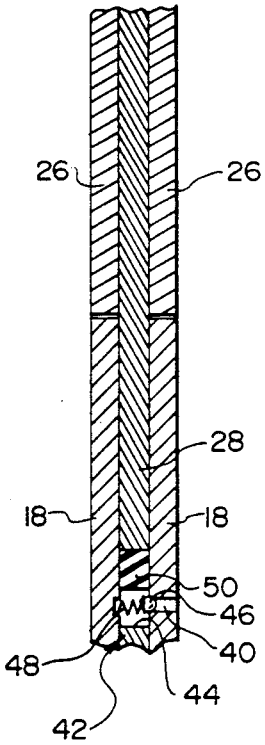
FIG. 5 is a top fragmentary sectional view taken generally along line 5—5 of FIG. 1.

As best seen in FIG. 5, an access port 40 is provided in order to afford fluid communication from outside the base portion 12 of the cutting bar 10 to a plenum 42 defined within the channel 34 by the upper and lower track forming members 20, 22, the lateral plates 18 sandwiching those members 20, 22 therebetween, an inner wall 44 defining the base of the channel 34, and the piston 28, when the piston 28 is received within the channel 34. FIG. 5 also shows a ball check valve 46 as being seated internally within the plenum 42 against the access port 40. The ball check valve 46 is biased to a closure position by means of a coil spring 48. It will be understood, however, that any appropriate biasing means could be employed.

As will be able to be seen in view of this disclosure, increasing of fluid pressure within the plenum 42 will serve to urge the piston 28 outwardly and concurrently drive the distal portion 14 of the cutting bar 10 relatively outward with respect to the base portion 12. By increasing fluid pressure within the plenum 42, therefore, the chain can be tensioned.

It is frequently necessary to grease or oil an implement such as a chain saw. It is envisioned that, while performing such a function, grease, for example, could be injected into the plenum 42 through the access port 40. Increased pressure in a grease gun would overcome the biasing of the ball check valve 46, and grease would enter into the plenum 42 to drive the piston 28 outwardly. As the grease gun would be withdrawn, however, the spring 48 would bias the ball check valve 46 to a closure position to preclude egress of the injected fluid. As a result, the piston 28 would be maintained in its extended disposition. The chain would, thereby, be maintained in a tensioned configuration.

FIGS. 1, 4A, and 5 illustrate a seal 50 which, if used, would be received within the channel 34 against the inner face 52 of the piston 28. The size and shape of the seal 50 would be selected in view of the dimensions of the channel 34. The figures illustrate a "block" seal member 50 which has dimensions so as to preclude leakage of fluid around the piston 28.

It will be understood that, while grease has been described as a fluid that could function to effect extension of the piston 28, such a fluid is not exclusive. Other fluids, such as air, could be employed in certain embodiments to effect extension.

Figure 6:
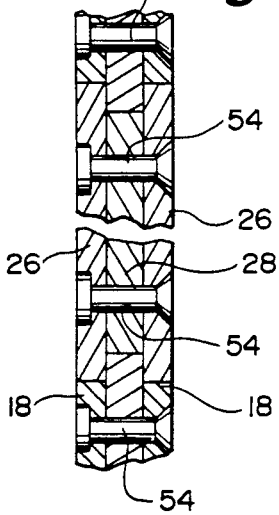
FIG. 6 a side fragmentary sectional view taken generally along line 6—6 of FIG. 1.

FIG. 6 illustrates a cross-section of the cutting bar 10 at a location intersecting both the distal portion 14 and the base portion 12 thereof. As is able to be seen in that figure, rivets 54 or other appropriate securing means can be employed to effect a tight sandwiching of the various laminar structures. It will be understood, however, that any appropriate securing means could be employed.

FIG. 2 illustrates a second embodiment of the invention. This embodiment employs mechanical means, rather than hydraulic or pneumatic means, to effect extension of the piston 28 and outward relative movement of the distal portion 14 of the cutting bar 10 relative to the base portion 12. The construction of the distal portion 14 and base portion 12 of the cutting bar 10 are substantially identical to the construction of those components in the embodiment of FIG. 1. In FIG. 2, however, an axially-extending channel 34 in the base portion 12 communicates with a circular aperture 56 sandwiched between the lateral laminar plates 18. The piston 28, thereby, extends into this circular aperture 56. A cam 58 is mounted within this aperture 56 and journalled between the lateral plates 18. It is disposed for rotation about an axis which is oriented generally transverse to an intended direction of extension of the distal portion 14 of the cutting bar 10 and the piston 28 carried thereby.

The cam 58 is mounted for rotation so that an outermost edge 60 thereof passes closely proximate a toothed, circumferential edge 62 defining the circular aperture 56. The outermost edge 60 of the cam 58 can, in one embodiment, carry a pawl structure 64. The pawl 64 would be outwardly biased so that a toothed surface 66 thereof would cooperate with the toothed circumferential edge 62 of the generally circular aperture 56 in the base portion 12 of the cutting bar 10 to preclude rotation of the cam 58 in a second direction (counterclockwise as viewed in FIG. 2).

As seen in FIG. 2, the cam 58 is provided with a coaxial, faceted aperture 68 which is accessible externally with respect to the cutting bar base portion sandwiching plates 18. In the embodiment illustrated, this aperture 68 is square. It will be understood, however, that any faceted geometric figure would be appropriate. The aperture 68 receives the insertion of a correspondingly sized and shaped tool (not shown) so that the cam 58 can be volitionally rotated in a first direction (a clockwise direction as viewed in FIG. 2).

When tensioning of the chain is necessary, the tool is inserted into the faceted aperture 68, and the cam 58 is rotated in the first direction. The directions of cant of the teeth of the circumferential edge 62 defining the circular aperture 56 and of the teeth of the toothed surface 66 of the pawl 64 are such that the rotation of the cam 58 in the first direction will not be precluded. Intermeshing of the teeth, however, will preclude rotation in the second direction. When the tool is inserted into the faceted aperture 68 and the cam 58 is rotated in the first direction, therefore, an increasingly larger radiused section of the cam 58 will be made to engage the inner face 52 of the piston 28, and the piston 28 will, concurrently, be urged outwardly. Rotation of the cam 58 in the first direction will thereby effect "cinching up" of the piston 28 in an outwardly direction. As will be able to be seen in view of this disclosure, therefore, the chain will be tensioned as a result.

FIG. 3 illustrates a third embodiment of the invention. The embodiment of FIG. 3 again employs mechanical means. In the case of this embodiment, however, tensioning is effected automatically. Again, construction of the distal portion 14 of the cutting bar 10 is substantially the same as in the case of the embodiments of FIGS. 1 and 2. That is, a piston 28 extends inwardly within a channel 34 defined within the base portion 12 of the cutting bar 10.

In the embodiment of FIG. 3, however, a strong spring member 70 is disposed generally centrally within the channel 34. One end of the spring member 70 engages a base 44 of the channel 34, and the other end engages the piston 28 through an intermediate transmission member portion 72 of the piston 28 which is disposed between the spring 70 and a main portion of the piston 28. It will be understood that, while FIG. 3 shows transmission member portion 72 as being separate from the main portion of the piston 28, transmission member portion 72 could, in fact, be formed integrally with the main portion of the piston 28.

FIG. 3 shows this transmission member portion 72 as being generally trapezoidal in shape, upper and lower sloped surfaces 74, 76 thereof converging toward the center of the channel 34 as they approach the base 44 of the channel 34. That figure also illustrates the transmission member portion 72 as carrying a pin 78 which is positioned to ride along a longitudinally extending slot 80 in one or both of the lateral sandwiching plates 18 of the base portion 12 of the cutting bar 10. More positive control of movement of the transmission member portion 72 is, thereby, afforded.

As previously indicated, the transmission member portion 72 is intermediate the urging spring 70 and the inner face 52 of the piston 28, and the member portion 72 engages the inner face 52 of the piston 28 at its end opposite that engaged by the spring 70. Consequently, force exerted upon the transmission member portion 72 by the spring 70, is, in turn, transmitted to the distal portion 14 of the cutting bar 10 to urge the sprocket 16 outwardly in order to effect tensioning of the chain.

FIG. 3 also illustrates means which function to inhibit withdrawal of the piston 28 within the channel 34 during operation of the chain saw. As will be understood, the outward urging of the distal portion 14 of the cutting bar 10 by the spring 70 occurs when the chain saw implement is in a non-operational mode. If such means to inhibit withdrawal were not provided, during operation of the chain saw, the sprocket 16 might be driven inwardly against the bias of the spring 70 urging the piston 28 outwardly.

FIG. 3 illustrates one embodiment of such means. Shown are a pair of ramp members 82 received within the channel 34, each member 82 engaging an upper or lower edge of the channel 34, on a first side, and having sloped second sides 84 in engagement with corresponding sloped edges 74, 76 of the transmission member 72. The ramp members 82 operatively cooperate with the transmission member portion 72 since the angles of the ramp members 82 are complementary with those of the transmission member portion 72. As a result, the transmission member portion 72 is rotationally posited within the channel 34.

As seen in FIG. 3 also, each ramp member 82 is biased outwardly within the channel 34. A pair of second springs 86 are illustrated as being provided for this purpose. The pair of second springs 86, while being strong enough to urge the ramp members 82 outwardly within the channel 34, are less strong than the first spring 70 which engages the transmission member portion 72. Consequently, the primary urging of the distal portion 14 of the cutting bar 10 outwardly is effected by the first spring 70 acting against the transmission member portion 72. As the piston 28 and its transmission member portion 72 are moved outwardly, however, the second springs 86 urge the ramp members 82 outwardly so as to preclude withdrawal of the piston 28 back into the channel 34 during an operational mode of the chain saw implement.

Figure 7:
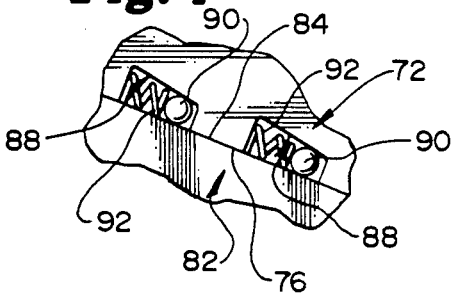
FIG. 7 is an enlarged side elevational view of a portion of a structure illustrated in FIG. 3 and identified within circle 7.

FIG. 7 illustrates one sloped surface 76 of the transmission member portion 72 as having a plurality of recesses 88 formed therein. Each recess 88 is provided with a roller bearing 90 which is biased to the lower end of the recess 88 by, for example, a small coil spring 92. As shown in FIG. 7, the lower end of the recess 88 has a smaller dimension perpendicular to sloped surface 76 than does the upper end of the recess 88. As a result, when a roller bearing 90 is at the lower end of the recess 88 in which it is received, bearing 90 will more significantly protrude from recess 88. In view of the location to which the roller bearing 90 is urged by coil spring 92 within its corresponding recess 88, therefore, and the commensurate greater protrusion of bearing 90 from recess 88 and resultant increased wedging effect withdrawal of the piston 28 and transmission member portion 72 back within the channel 34 will be more effectively inhibited. Extension of the piston 28 and distal portion 14 of the cutting bar 10 with which the piston 28 operates will not, however, be retarded, since ramp members 82 do not work against extension.

FIG. 3 illustrates a corresponding plurality of recesses 88 formed in an upper sloped surface 74 of the piston transmission member portion 72. It will be understood, however, that such a recess or recesses 88 are not essential to the invention, and embodiments wherein no recesses are provided or more or less than two recesses are provided in each sloped surface 74, 76 are within the scope of the invention.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A chain saw with means for tensioning a chain of the chain saw, the chain saw comprising:

(a) a cutting bar around which the chain extends, said cutting bar including a base portion mounted to an operating housing of the chain saw and a distal portion carried by said base portion at an end thereof remote from the operating housing, said distal portion being disposed, relative to said base portion, for sliding extension relative thereto, said base portion of said cutting bar having a channel formed therewithin and an access port communicating with said channel proximate an inner end thereof, and wherein said distal portion of said cutting bar includes an inwardly extending piston received within said channel for telescoping movement therealong, wherein fluid can be injected, through said access port, into a plenum defined within said channel inwardly of said position to effect extension of said distal portion of said cutting bar relative to said base portion of said cutting bar; and (b) a sprocket, around which the chain passes, mounted at an outer end of said distal portion of said cutting bar and disposed for rotation about an axis.

2. Apparatus in accordance with claim 1 further including sealing means to inhibit leakage of fluid out of said channel around said piston.

3. Apparatus in accordance with claim 2 further including means for normally closing said access port and affording one-way passage of fluid into said plenum through said access port.

4. A chain saw with means for tensioning a chain of the chain saw, the chain saw comprising:

(a) a cutting bar around which the chain extends, said cutting bar including a base portion mounted to an operating housing of the chain saw and a distal portion carried by said base portion at an end thereof remote from the operating housing, said distal portion being disposed, relative to said base portion, for sliding extension relative thereto, said base portion of said cutting bar including a piston received within an axially-disposed channel formed in said base portion of said cutting bar;

(b) a sprocket, around which the chain passes, mounted at an outer end of said distal portion of said cutting bar and disposed for rotation about an axis; and (c) a cam having an outer surface in engagement with an inner edge of said piston, said cam being disposed for rotation about an axis generally transverse to an intended direction of extension of said distal portion of said cutting bar so that, as said cam is rotated about said axis in a first direction, said piston will be urged outwardly.

5. Apparatus in accordance with claim 4 wherein said cam is received within a generally circular aperture within said base portion of said cutting bar, an outermost edge of said cam being closely proximate a circumferential edge of said generally circular aperture, as said cam is made to rotate.

6. Apparatus in accordance with claim 5 further comprising means for precluding rotation of said cam about said axis in a second direction.

7. Apparatus in accordance with claim 6 wherein said circumferential edge of said generally circular aperture is toothed, and wherein said rotation precluding means comprises a pawl carried by said cam at said outermost edge thereof in close proximity to said circumferential edge of said generally circular aperture, said pawl having teeth cooperating with said toothed circumferential edge of said generally circular aperture and being outwardly biased to preclude rotation of said cam in said second direction.

8. A chain saw with means for tensioning a chain of the chain saw, the chain saw comprising:

(a) a cutting bar around which the chain extends, said cutting bar including a base portion mounted to an operating housing of the chain saw and a distal portion carried by said base portion at an end thereof remote from the operating housing, said distal portion being disposed, relative to said base portion, for sliding extension relative thereto, said base portion of said cutting bar including a piston received within an axially-disposed channel formed in said base portion of said cutting bar;

(b) a sprocket, around which the chain passes, mounted at an outer end of said distal portion of said cutting bar and disposed for rotation about an axis; and (c) a spring in engagement, at one end thereof, with a base of said channel and, at another end thereof, with an inner edge of said piston;

(d) wherein upper and lower edges of said piston slope inwardly toward a center of said channel, and further comprising means for inhibiting withdrawal of said piston within said channel during operation of the chain saw.

9. Apparatus in accordance with claim 8 wherein said inhibiting means comprises a pair of ramp members received within said channel, each having a sloped surface in cooperative engagement with a corresponding sloped edge of said piston, and means biasing said ramp members outwardly within said channel.

10. Apparatus in accordance with claim 9 wherein each sloped edge of said piston has a recess formed therein, said recess having a dimension perpendicular to said edge of said piston in which said recess is formed, at an end thereof most closely proximate said center of said channel, greater than a dimension perpendicular to said edge of said piston in which said recess is formed, at an end thereof most remote from said center of said channel, each recess having a roller bearing received therewithin and means for biasing said roller bearing to said end of said recess most remote from said center of axis channel.

* * * * *